United States Patent [19]

Port et al.

[11] Patent Number: 5,000,785

[45] Date of Patent: Mar. 19, 1991

[54] METHOD FOR CONTROLLING THE OXYGEN CONTENT IN AGGLOMERATED MOLYBDENUM POWDERS

[75] Inventors: David J. Port, Sayre; Joseph E. Ritsko, Towanda, both of Pa.

[73] Assignee: GTE Products Corporation, Stamford, Conn.

[21] Appl. No.: 325,591

[22] Filed: Mar. 20, 1989

Related U.S. Application Data

[63] Continuation-in-part of Ser. No. 247,889, Aug. 22, 1988, abandoned, which is a continuation-in-part of Ser. No. 38,190, Apr. 13, 1987, abandoned, which is a continuation of Ser. No. 828,801, Feb. 12, 1986, abandoned.

[51] Int. Cl.[5] ..... C22B 1/14

[52] U.S. Cl. ..... 75/751

[58] Field of Search ..... 423/606; 209/10, 233; 75/751

[56] References Cited

U.S. PATENT DOCUMENTS 3,973,948 8/1976 Laferty ..... 75/244

4,146,388 3/1979 Lafferty et al. ..... 75/252

OTHER PUBLICATIONS

Ermelin Handbook of Inorganic Chemistry, Supplement, vol. A3, System-No. 53, Springer-Verlag, N.Y., 1983, pp. 122-123.

"Properties of Oxygen Bearing Molybdenum Coatings", published in the Proceedings of the 9th International Thermal Spray Conference, Netherlands, Denhaag, May 19-23, 1980.

Hackh's Chemical Dictionary 4th Ed., McGraw Hill, N.Y., 1969, p. 543.

*Primary Examiner*—Melvyn J. Andrews

*Attorney, Agent, or Firm*—Donald R. Castle; L. Rita Quatrini

[57] ABSTRACT

A method is disclosed for controlling the level of oxygen in molybdenum metal powder, which comprises agglomerating and sintering the molybdenum powder, classifying the resulting agglomerated and sintered molybdenum powder to obtain a particle size of from about −200 to about +325 mesh, contacting the resulting classified powder with a sufficient amount of an aqueous solution of hydrogen peroxide containing from about 1% to about 10% by weight of hydrogen peroxide to yield a molar ratio of $H_2O_2$:Mo of from about 2 to about 5 for sufficient time to achieve an oxygen content in the powder of from about 1% to about 15% by weight wherein the major portion of the oxygen is on the surface of the agglomerates, and removing the resulting hydrogen peroxide-treated molybdenum powder agglomerates from the resulting solution.

2 Claims, No Drawings

METHOD FOR CONTROLLING THE OXYGEN CONTENT IN AGGLOMERATED MOLYBDENUM POWDERS

This application is a continuation-in-part of application Ser. No. 247,889 filed Aug. 22, 1988, now abandoned which was a continuation-in-part of application Ser. No. 038,190 filed Apr. 13, 1987, now abandoned, which was a continuation of application Ser. No. 828,801, filed Feg. 12, 1986, now abandoned.

BACKGROUND OF THE INVENTION this invention relates to a method for controlling the oxygen content of agglomerated molybdenum powders by controlled oxidation of the powders. More particularly it relates to a method of introducing a controlled amount of oxygen into agglomerated molybdenum powders by contacting the powders with hydrogen peroxide to oxidize the molybdenum on the surface of the agglomerates. The powders are suitable for use in the plasma spray applications.

Flames spraying and plasma spraying are common techniques for the application of protective and wear resistant coatings of various metals, ceramics, and cermets, usually to metal surfaces (substrates). The piston ring industry commonly uses molybdenum coatings on rings for internal combustion engines.

In the flame spraying technique an electric arc or an oxyacetylene flame melts the end of a continuous coil of molybdenum wire and a gas propels it onto a substrate for example, the wear surface of a cast iron piston ring where it splats and solidifies, forming the coating in successive layers. Because of the presence of excess oxygen either from the flame or the surrounding air, or both, the coatings produced by this technique contain large quantities of oxygen, typically from about 7% to about 8% in solution and as various molybdenum oxides. The large quantities of oxygen in the molybdenum apparently harden the coating.

In the plasma spraying of molybdenum, there is usually a minimum of oxygen in the sprayed coating due to the use of an oxygen-lean plasma gas system. That is, argon, helium, hydrogen, nitrogen, or combinations of these gases, all of which are relatively free from oxygen, are used in the plasma spraying process. Hence, any oxygen in the sprayed coating is incidentally due to oxidation of the molten particles by oxygen impurity in the plasma gas and/or surface oxidation of the freshly deposited coating. Such coatings are softer than their flame sprayed counterparts.

For higher hardness, therefore, a more expensive process such as the flame spray process which requires wire, or a more expensive powder such as molybdenum plus nickel-base alloy must be used.

It would be desirable therefore to have a method of producing molybdenum powders of sufficiently high oxygen content to enable them to be used in a plasma spray process to produce hard coatings.

U.S. Pat. No. 4,146,388 describes and claims molybdenum plasma spray powders and a process for producing the powders of molybdenum and oxides of molybdenum having an oxygen content of from about 0.5 to about 15% by weight oxygen. The process involves passing molybdenum particles through a plasma with oxygen or oxides of molybdenum.

SUMMARY OF THE INVENTION

In accordance with one aspect of this invention, there is provided a method for controlling the level of oxygen in molybdenum metal powder, which comprises agglomerating and sintering the molybdenum powder, classifying the resulting agglomerated and sintered molybdenum powder to obtain a particle size of from about −200 to about +325 mesh, contacting the resulting classified powder with a sufficient amount of an aqueous solution of hydrogen peroxide containing from about 1% to about 10% by weight of hydrogen peroxide to yield a molar ratio of $H_2O_2$:Mo of from about 2 to about 5 for sufficient time to achieve an oxygen content in the powder of from about 1% to about 15% by weight wherein the major portion of the oxygen is on the surface of the agglomerates, and removing the resulting hydrogen peroxide-treated molybdenum powder agglomerates from the resulting solution.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

In the particular applications in which the controlled oxygen agglomerated molybdenum powders resulting from the method of this invention are preferably used, that is, in plasma spray applications to produce hard coatings, the desired oxygen content is from about 1% to about 15%. At levels lower than this, the hardness of the plasma coating is not improved. At levels higher than this range, coating integrity or bond strength is compromised.

By controlling the particle size of the molybdenum powder in the agglomerated form, the contact time, the amount and dilution of the oxidizing solution, and the ratio of the molybdenum to the oxidizing agent according to the present invention, the desired level of oxygen is achieved and the powder is sufficiently dense and suitable for plasma coating applications.

In the practice of this invention, the molybdenum powder is agglomerated by methods which are well known in the art.

One preferred method of agglomerating the molybdenum powder is described in U.S. Pat. No. 3,973,948. Methods are disclosed also in a paper entitled "Properties of Oxygen-Bearing Molybdenum Coatings," published in the proceedings of the Ninth International Thermal Spray Conference, Denhaag, Netherlands, May 19–23, 1980.

The agglomerated molybdenum powder is then sintered by methods which are well known in the art to densify the powder.

The resulting sintered agglomerates are then classified to obtain a particle size of from about −200 mesh to about +325 mesh.

By the method of this invention, the oxygen content of molybdenum powders which preferably consist essentially from about 0.05% to about 0.2% by weight is increased by contacting the powder with a sufficient amount of an aqueous solution of hydrogen peroxide containing from about 1% to about 10% by weight of hydrogen peroxide to yield a molar ratio of $H_2O_2$:Mo of from about 2 to about 5 for sufficient time to achieve an oxygen content in the powder of from about 1% to about 15% by weight. The amount of hydrogen peroxide is sufficient to raise the oxygen to the desired level, but not in excess amounts to cause the reaction to be uncontrolled. A dilute solution of the hydrogen peroxide affords better control and avoids excessive oxidation. Also in order to achieve the desired oxygen level in the powder, it is important that the particle size of the powder be from about −200 mesh to about +325 mesh. By having the particle size as described above and by having the powder in the form of agglomerates and contacting with hydrogen peroxide in the manner described above, the major portion of the oxygen is on the surface of the agglomerates. With the oxygen remaining on the surface of the agglomrates, the density of the agglomerates is retained, thus allowing free flowability so that they can pass efficiently through a plasma in plasma coating applications. When the powder is not agglomerated, the oxygen is distributed throughout the powder. This results in the powder becoming less dense and therefore the powder does not flow freely through a plasma.

The resulting partially oxidized molybdenum powder is then separated from the resulting solution by any standard technique such as filtration.

To more fully illustrate this invention, the following non-limiting example is presented.

EXAMPLE

About 7 grams of molybdenum powder type SA-101 from GTE which has been agglonerated by spray drying and which is −200, +325 mesh and containing about 0.2% by weight oxygen is contacted with a solution consisting essentially of about 6 cc of 30% hydrogen peroxide in about 150 cc of deionized water for about 2 hours. The resulting partially oxidized molybdenum powder is then filtered off and dried. Analysis of this powder shows an oxygen content of about 1.8% by weight.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for controlling the level of oxygen in molybdenum metal powder, said method comprising:

(a) agglomerating said molybdenum powder;

(b) sintering the resulting agglomerated powder;

(c) classifying the resulting agglomerated and sintered molybdenum powder to obtain a particle size of from about −200 to about +325 mesh;

(d) contacting the resulting classified powder with a sufficient amount of an aqueous solution of hydrogen peroxide containing from about 1% to about 10% by weight of hydrogen peroxide to yield a molar ration of $H_2O_2$:Mo of from about 2 to about 5 for sufficient time to achieve an oxygen content in said powder of from about 1% to about 15% by weight wherein the major portion of said oxygen is on the surface of the agglomerates; and (e) removing the resulting hydrogen peroxide-treated molybdenum powder agglomerates from the resulting solution.

2. A method of claim 1 wherein said molybdenum powder prior to said contacting contains from about 0.05 to about 0.2 percent by weight of oxygen.

* * * * *